US008928539B2

(12) United States Patent
Onaka et al.

(10) Patent No.: US 8,928,539 B2
(45) Date of Patent: Jan. 6, 2015

(54) ANTENNA UNIT AND RADIO COMMUNICATION DEVICE

(71) Applicant: Murata Manufacturing Co., Ltd., Kyoto-fu (JP)

(72) Inventors: Kengo Onaka, Kyoto-fu (JP); Osamu Shibata, Kyoto-fu (JP); Yuichi Kushihi, Kyoto-fu (JP)

(73) Assignee: Murata Manufacturing Co., Ltd., Kyoto-fu (JP)

( * ) Notice: Subject to any disclaimer, the term of this patent is extended or adjusted under 35 U.S.C. 154(b) by 169 days.

(21) Appl. No.: 13/775,006

(22) Filed: Feb. 22, 2013

(65) Prior Publication Data

US 2013/0162488 A1 Jun. 27, 2013

Related U.S. Application Data

(63) Continuation of application No. PCT/JP2011/064596, filed on Jun. 25, 2011.

(30) Foreign Application Priority Data

Aug. 31, 2010 (JP) ..... 2010-194233

(51) Int. Cl.

| | |
|---|---|
| ***H01Q 21/30*** | (2006.01) |
| ***H01Q 1/38*** | (2006.01) |
| ***H01Q 7/00*** | (2006.01) |
| ***H01Q 9/42*** | (2006.01) |

(52) U.S. Cl.

CPC . *H01Q 1/38* (2013.01); *H01Q 7/00* (2013.01); *H01Q 9/42* (2013.01); *H01Q 21/30* (2013.01)

USPC ..... 343/728; 343/700 MS; 343/702; 343/725

(58) Field of Classification Search

CPC ..... H01Q 1/38; H01Q 21/30; H01Q 7/00

USPC ..... 343/700 MS, 702, 725, 728, 729

See application file for complete search history.

(56) References Cited

U.S. PATENT DOCUMENTS 5,945,959 A * 8/1999 Tanidokoro et al. ..... 343/728
6,753,815 B2 * 6/2004 Okubora et al. ..... 343/700 MS (Continued)

FOREIGN PATENT DOCUMENTS

CN 1332489 A 1/2002
CN 2629238 Y 7/2004

(Continued)

OTHER PUBLICATIONS

The first Office Action issued by the State Intellectual Property Office of People's Republic of China on Mar. 19, 2014, which corresponds to Chinese Patent Application No. 201180041939.7 and is related to U.S. Appl. No. 13/775,006; with English language translation.

(Continued)

*Primary Examiner* — Tho G Phan

(74) *Attorney, Agent, or Firm* — Studebaker & Brackett PC

(57) ABSTRACT

An antenna unit and a radio communication device are provided. An antenna unit has a monopole antenna section and a loop antenna section. The monopole antenna section includes a linear radiating electrode that resonates at a first frequency and has an electrical length of one-quarter of the wave length corresponding to the first frequency. The loop antenna section includes a radiating electrode that resonates at a second frequency, is vertically erected on a non-ground region, and connected to a feed line. A proximal end of the radiating electrode of the loop antenna section is connected to an intermediate portion of the feed line, and a distal end thereof is connected to a ground region. The electrical length of the radiating electrode of the loop antenna section is one-half of the wave length of the second frequency.

19 Claims, 8 Drawing Sheets

(56) References Cited

U.S. PATENT DOCUMENTS

| | | | | |
|---|---|---|---|---|
| 6,894,649 | B2 * | 5/2005 | Ostervall | 343/702 |
| 7,825,863 | B2 * | 11/2010 | Martiskainen et al. | 343/702 |
| 8,098,206 | B2 * | 1/2012 | Schatzle | 343/725 |
| 8,217,841 | B2 * | 7/2012 | Hossain et al. | 343/700 MS |
| 8,810,458 | B2 * | 8/2014 | Mumbru et al. | 343/702 |
| 2001/0040531 | A1 | 11/2001 | Saito | |
| 2004/0246188 | A1 | 12/2004 | Egashira | |
| 2005/0259010 | A1 | 11/2005 | Soutome | |
| 2005/0285809 | A1 | 12/2005 | Louzir et al. | |
| 2007/0146221 | A1 | 6/2007 | Oshiyama et al. | |
| 2007/0249313 | A1 | 10/2007 | Oshiyama et al. | |
| 2008/0088509 | A1 | 4/2008 | Qin | |
| 2014/0078009 | A1 * | 3/2014 | Wong et al. | 343/728 |

FOREIGN PATENT DOCUMENTS

| | | | |
|---|---|---|---|
| CN | 1574456 | A | 2/2005 |
| CN | 1585191 | A | 2/2005 |
| CN | 1679207 | A | 10/2005 |
| CN | 1992434 | A | 7/2007 |
| CN | 101060204 | A | 10/2007 |
| CN | 101162801 | A | 4/2008 |
| CN | 101673882 | A | 3/2010 |
| JP | 2001-284935 | A | 10/2001 |
| JP | 2004-312628 | A | 11/2004 |
| JP | 2005-101840 | A | 4/2005 |
| JP | 2005-142739 | A | 6/2005 |
| JP | 2008-072204 | A | 3/2008 |
| JP | 4284141 | B2 | 6/2009 |

OTHER PUBLICATIONS

International Search Report; PCT/JP2011/064596; Sep. 20, 2011.

Written Opinion of the International Searching Authority; PCT/JP2011/064596; Sep. 20, 2011.

* cited by examiner

ANTENNA UNIT AND RADIO COMMUNICATION DEVICE

CROSS REFERENCE TO RELATED APPLICATIONS

The present application is a continuation of International Application No. PCT/2011/064596 filed on Jun. 25, 2011, and claims priority to Japanese Patent Application No. 2010-194233 filed on Aug. 31, 2010, the entire contents of each of these applications being incorporated herein by reference in their entirety.

TECHNICAL FIELD

The technical field relates to an antenna unit used for cellular phones or the like, and a radio communication device.

BACKGROUND

With the increasing functionality and miniaturization of radio communication devices such as cellular phones in recent years, multi-resonance and miniaturization of antenna units used in such radio communication devices are being pursued.

As such antenna units, for example, there are techniques disclosed in Japanese Unexamined Patent Application Publication No. 2005-101840 (Patent Document 1) and Japanese Unexamined Patent Application Publication No. 2004-312628 (Patent Document 2).

The antenna unit disclosed in Patent Document 1 handles a wide band ranging from 3 GHz to 10 GHz by means of two antennas including first and second antennas, thereby achieving multi-resonance and miniaturization of the unit.

Specifically, the operating frequency of the second antenna is set to substantially twice the operating frequency of the first antenna, and the first and second antennas cover 3 GHz to 5 GHz and 6 GHz to 10 GHz, respectively. With this setting, the operating frequency of one of the antennas becomes the anti-resonant frequency of the other antenna, thereby preventing interference of radio waves.

The antenna unit disclosed in Patent Document 2 is a double-resonance diversity antenna unit that handles 2 GHz and 5 GHz. The antenna unit achieves miniaturization and high performance by use of three antennas.

Specifically, the antenna unit is formed by arranging three antenna elements on a circuit board. The three antenna elements are a dual-band antenna adapted to both 2 GHz and 5 GHz bands, an antenna dedicated to 2 GHz, and an antenna dedicated to 5 GHz. The dual-band antenna and the antenna dedicated to 2 GHz are formed as pattern antennas, and the antenna dedicated to 5 GHz is formed as an inverted-F metal plate antenna.

SUMMARY

The present disclosure provides an antenna unit that can be mounted even in a small area and further has superior non-interference property, and a radio communication device.

In an aspect of the disclosure, an antenna unit includes a single feed line extending from a feed section onto a non-ground region of a surface of a board, a monopole antenna section that has a radiating electrode having a linear shape, the radiating electrode being provided on the non-ground region, the radiating electrode being connected at its proximal end to a distal end portion of the feed line and being open at a distal end thereof, and a loop antenna section including a radiating electrode having a half-loop shape and being vertically erected on the non-ground region, the radiating electrode of the loop antenna section a proximal end and a distal end, the proximal end of the loop antenna radiation electrode being connected to an intermediate portion of the feed line and the distal end of the loop antenna radiation electrode being grounded, in which an electrical length of the radiating electrode in the monopole antenna section is set to one-quarter of a wave length corresponding to a first frequency, and an electrical length of the radiating electrode in the loop antenna section is set to one-half of a wave length corresponding to a second frequency that is approximately twice the first frequency.

In a more specific embodiment, a ground layer may be provided in a location on a backside of the board opposite to the radiating electrode of the loop antenna section, and the distal end of the radiating electrode of the loop antenna section connected to the ground layer.

In another more specific embodiment, the radiating electrode of the loop antenna section may be formed on a surface of a dielectric base attached onto the non-ground region.

In yet another more specific embodiment, a choke coil for blocking a signal at the second frequency may be interposed between the proximal end of the radiating electrode of the monopole antenna section and the distal end portion of the feed line.

In another more specific embodiment, in an antenna unit according to any of the above embodiments, the first frequency may be 2.4 GHz, and the second frequency may be 5 GHz.

In another aspect of the disclosure, a radio communication device includes an antenna unit according to any one of the above embodiments.

DETAILED DESCRIPTION

The inventors realized that antenna units according to the related art mentioned above have the following problems.

First, in the case of the antenna unit disclosed in Patent Document 1, it is necessary to set the anti-resonant frequency of the first antenna to the resonant frequency of the second antenna. However, such an antenna design is very difficult because even a slight change to the structure of one antenna greatly alters the anti-resonant frequency or anti-resonance band width of the antenna. Moreover, when the band width of high impedance centered around the anti-resonant frequency is narrow, interference tends to occur between the first antenna and the second antenna.

Next, in the case of the antenna unit disclosed in Patent Document 2, three antenna elements including the dual-band antenna, the antenna dedicated to 2 GHz, and the antenna dedicated to 5 GHz are arranged on a narrow circuit board, with the result that these three antennas are located in close distance to each other. With the miniaturization of radio communication devices in recent years, the area on the board where an antenna(s) can be mounted is becoming smaller. When the three antennas are mounted in such a small area, the antennas are located in extremely close proximity to one another, which can cause not only interference between the dual antenna and the antenna dedicated to 2 GHz or interference between the dual antenna and the antenna dedicated to 5 GHz, but also interference between the antenna dedicated to 2 GHz and the antenna dedicated to 5 GHz.

Hereinafter, exemplary embodiments of the present disclosure that can address the above shortcomings will be described with reference to the drawings.

Figure 1:
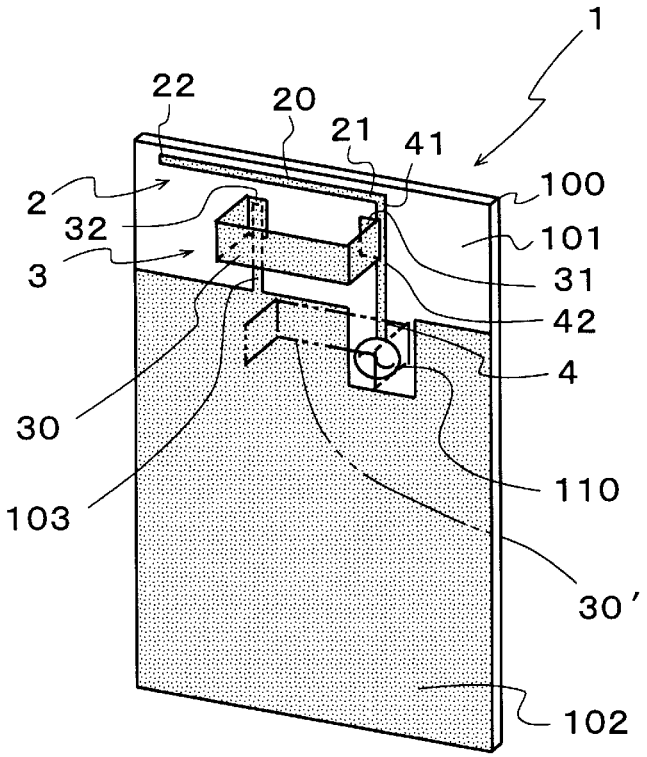
FIG. 1 is a perspective view of a board to which an antenna unit according to a first exemplary embodiment is applied.
Figure 2:
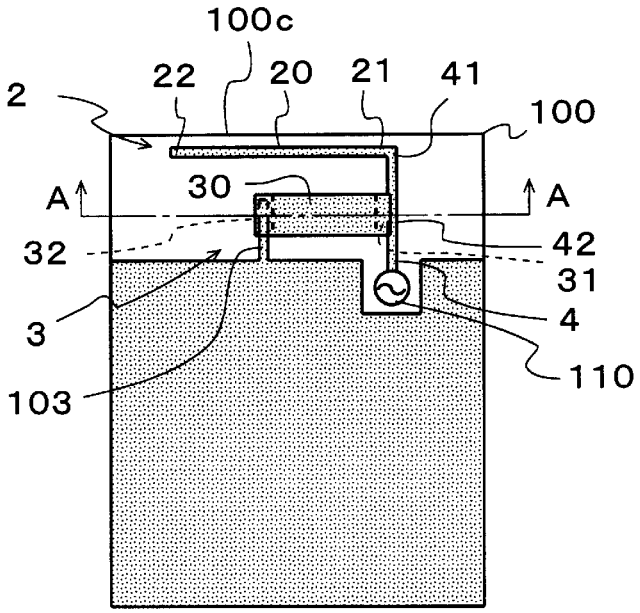
FIG. 2 is a plan view of the board illustrated in FIG. 1.
Figure 3:
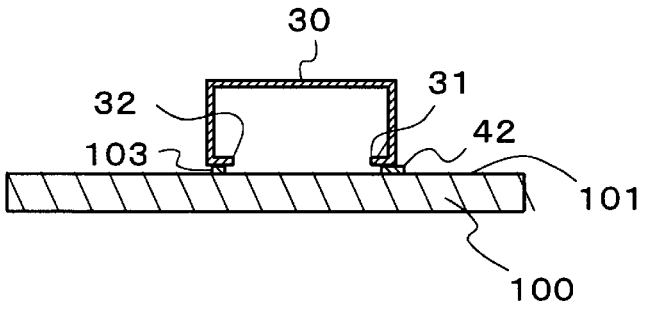
FIG. 3 is a cross-sectional view in the direction of arrow A-A in FIG. 2.

FIG. 1 is a perspective view of a board to which an antenna unit according to a first exemplary embodiment is applied. FIG. 2 is a plan view of the board illustrated in FIG. 1. FIG. 3 is a cross-sectional view in the direction of arrow A-A in FIG. 2.

As illustrated in FIG. 1 and FIG. 2, the antenna unit according to this embodiment is mounted on a board 100 of a radio communication device.

An antenna unit 1 is a dual antenna having a monopole antenna section 2 and a loop antenna section 3. The monopole antenna section 2 and the loop antenna section 3 share a single feed section 110.

The monopole antenna section 2 is an antenna section for transmitting and receiving a signal at 2.4 GHz that is a first frequency. The monopole antenna section 2 is provided on a non-ground region 101 of the board 100.

Specifically, a radiating electrode 20 having a linear shape is connected to a single feed line 4.

That is, the feed line 4 is extended from the feed section 110 onto the non-ground region 101 of the surface of the board 100. The radiating electrode 20 is formed as a horizontal pattern on the non-ground region 101. A proximal end 21 of the radiating electrode 20 is connected to a distal end portion 41 of the feed line 4, and a distal end 22 is open.

The electrical length of the radiating electrode 20 mentioned above is set to one-quarter of the wave length corresponding to the operating frequency of 2.4 GHz.

The loop antenna section 3 is an antenna section for transmitting and receiving a signal at 5 GHz that is a second frequency. The loop antenna section 3 is provided on the non-ground region 101, near the monopole antenna section 2.

Specifically, a radiating electrode 30 having a half-loop shape is connected to the feed line 4.

That is, as illustrated in FIG. 3, the radiating electrode 30 is formed by a conductive member that is bent in a U-shape so as to form a half-loop. A proximal end 31 and a distal end 32 of the radiating electrode 30 are bent horizontally toward the inside of the radiating electrode 30 so as to face each other.

The radiating electrode 30 mentioned above is vertically erected on the non-ground region 101, with the proximal end 31 and the distal end 32 being directed toward the non-ground region 101. The proximal end 31 of the radiating electrode 30 is connected to an intermediate portion 42 of the feed line 4, and the distal end 32 is connected to a ground region 102 on the board 100 through a line 103.

As described above, the loop antenna section 3 operates at a frequency of 5 GHz that is approximately twice the operating frequency of the monopole antenna section 2 which is 2.4 GHz. The electrical length of the radiating electrode 30 is set to one-half of the wave length of the operating frequency of 5 GHz.

As illustrated in FIG. 2, the loop antenna section 3 is arranged on the center side of the board 100 with respect to the monopole antenna section 2. This is because if the loop antenna section 3 is arranged near an edge portion 100*c* of the board 100, the radiating electrode 30 that has a height may come into contact with a resin case or nearby object (not illustrated). Arranging the loop antenna section 3 in this way prevents the radiating electrode 30 from hitting a nearby object or hand and becoming damaged or detached.

Next, the operation and effect of the antenna unit 1 according to the present embodiment will be described.

Figure 4:
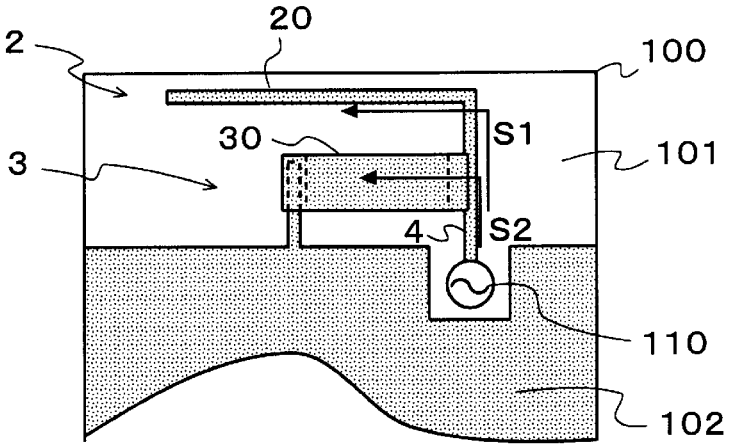
FIG. 4 is a plan view illustrating flows of signals.

FIG. 4 is a plan view illustrating flows of signals.

As illustrated in FIG. 4, when a signal S1 at 2.4 GHz is outputted from the feed section 110, the radiating electrode 20 of the monopole antenna section 2 becomes resonant, and the horizontally polarized wave of the signal S1 is radiated from the radiating electrode 20. When a signal S2 at 5 GHz is outputted from the feed section 110, the radiating electrode 30 of the loop antenna section 3 becomes resonant, and the vertically and horizontally polarized waves of the signal S2 are radiated from the radiating electrode 30.

Therefore, use of the antenna unit 1 enables transmission and reception of the signal S1 at 2.4 GHz by the monopole antenna section 2, and transmission and reception of the signal S2 at 5 GHz by the loop antenna section 3.

The antenna unit 1 according to the present embodiment transmits and receives two signals, the signal S1 and the signal S2, through a single feed line 4. In this regard, for reasons stated below, such a configuration does not lead to a situation where the signal S1 at 2.4 GHz enters not only the monopole antenna section 2 but also the loop antenna section 3 to cause interference, and the signal S2 at 5 GHz enters not only the loop antenna section 3 but also the monopole antenna section 2 to cause interference.

Figure 5:
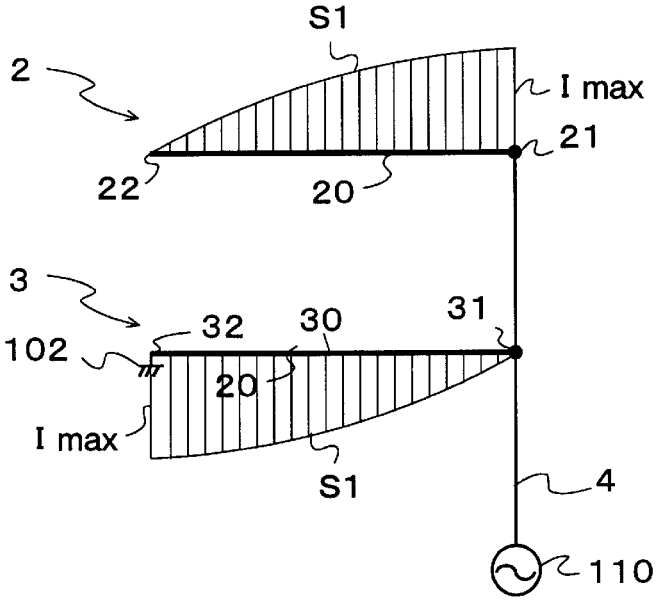
FIG. 5 is a schematic diagram for explaining non-interference performance with respect to the operating frequency of a monopole antenna section.
Figure 6:
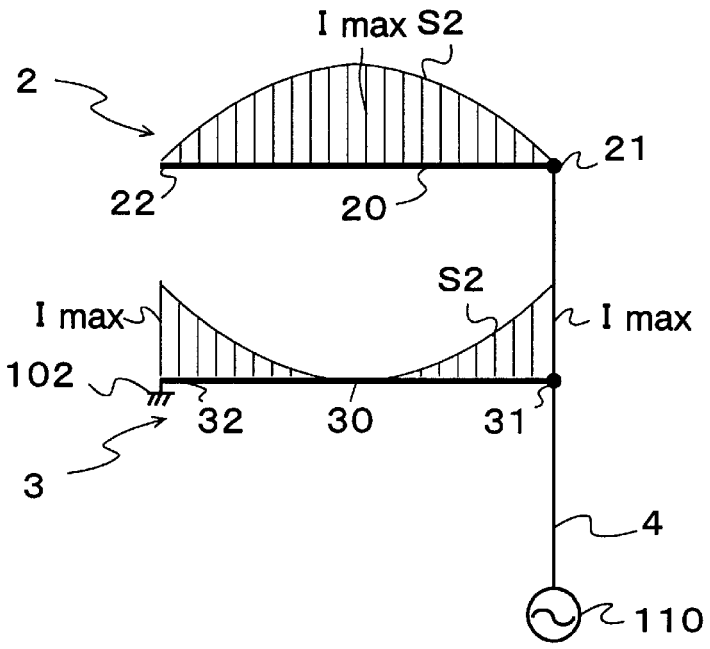
FIG. 6 is a schematic diagram for explaining non-interference performance with respect to the operating frequency of a loop antenna section.

FIG. 5 is a schematic diagram for explaining non-interference performance with respect to the operating frequency of the monopole antenna section 2. FIG. 6 is a schematic diagram for explaining non-interference performance with respect to the operating frequency of the loop antenna section 3.

Because the electrical length of the radiating electrode 20 of the monopole antenna section 2 is set to one-quarter of the wave length corresponding to 2.4 GHz, when the signal S1 at 2.4 GHz is fed from the feed section 110, as illustrated in FIG. 5, the radiating electrode 20 of the monopole antenna section 2 resonates in such a way that the current is at a minimum at the distal end 22, and the current is at a maximum Imax at the proximal end 21. Therefore, the proximal end 21 of the radiating electrode 20 becomes low impedance with respect to the feed section 110.

In contrast, because the electrical length of the radiating electrode 30 is set to one-half of a wave length λ2 corresponding to 5 GHz that is approximately twice of 2.4 GHz, when the signal S1 at 2.4 GHz is fed to the loop antenna section 3 from the feed section 110, in the radiating electrode 30 of the loop antenna section 3, the current is at a maximum Imax at the distal end 32, and the current is at a minimum at the proximal end 31. Consequently, the proximal end 31 of the radiating electrode 30 becomes high impedance with respect to the feed section 110, making it difficult for the radiating electrode 30 to resonate at 2.4 GHz. Therefore, a situation where the signal S1 at 2.4 GHz enters the radiating electrode 30 of the loop antenna section 3 to cause interference does not occur.

As illustrated in FIG. 6, when the signal S2 at 5 GHz is fed from the feed section 110, the radiating electrode 30 of the loop antenna section 3 resonates in such a way that the current is at a maximum Imax at the distal end 32 and the proximal end 31. Therefore, the proximal end 31 of the radiating electrode 30 becomes low impedance with respect to the feed section 110.

In contrast, when the signal S2 at 5 GHz is fed to the monopole antenna section 2 from the feed section 110, in the radiating electrode 20 of the monopole antenna section 2, the current is at a minimum at the distal end 22 and the proximal end 21. Consequently, the proximal end 21 of the radiating electrode 20 becomes high impedance with respect to the feed section 110, making it difficult for the radiating electrode 20 to resonate at 5 GHz. Therefore, it is difficult for the signal S2 at 5 GHz to enter the radiating electrode 20 of the monopole antenna section 2 to cause interference.

Moreover, in the antenna unit 1 according to this embodiment, the electric field in the vertical direction generated in the radiating electrode 30 becomes strong, and a strong vertically polarized component is radiated from the loop antenna section 3.

Figure 7:
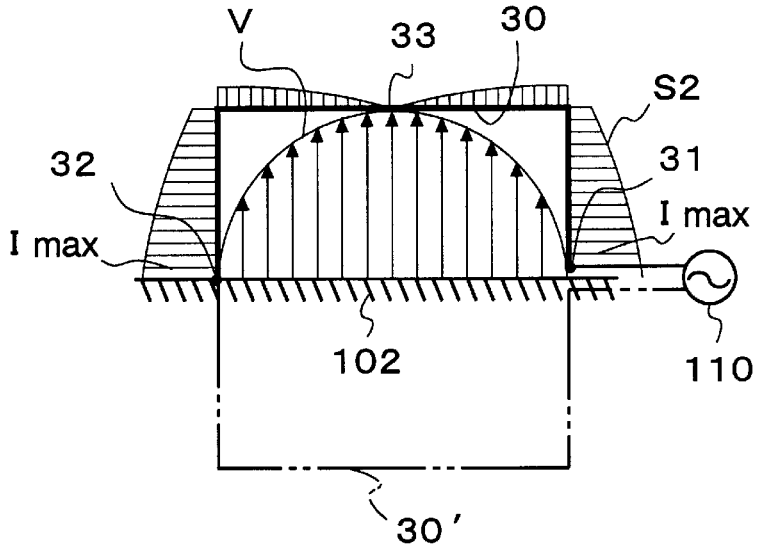
FIG. 7 is a schematic diagram for explaining current distribution and a vertically polarized wave that are generated in a radiating electrode of the loop antenna section.
Figure 8:
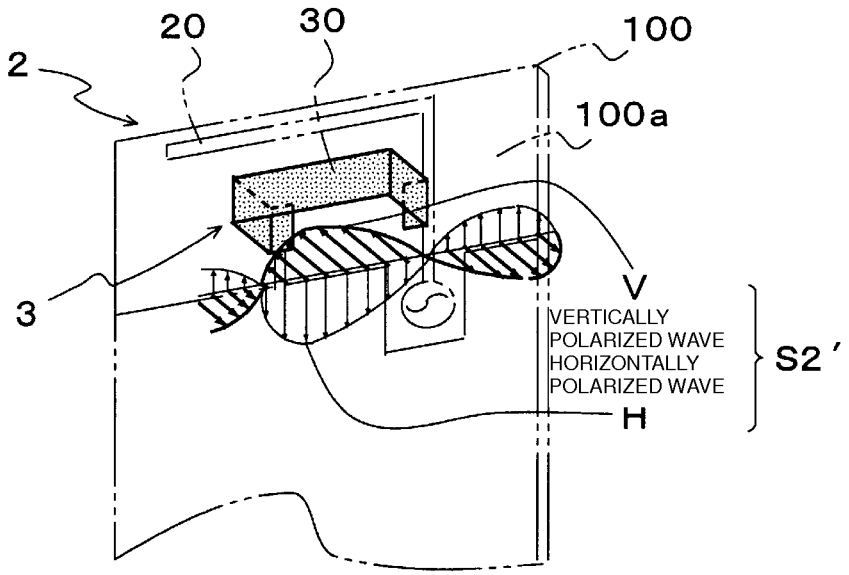
FIG. 8 is a perspective view illustrating a vertically polarized wave and a horizontally polarized wave generated in the radiating electrode of the loop antenna section.

FIG. 7 is a schematic diagram for explaining current distribution and a vertically polarized wave that are generated in the radiating electrode 30 of the loop antenna section 3. FIG. 8 is a perspective view illustrating a vertically polarized wave and a horizontally polarized wave generated in the radiating electrode 30.

As illustrated in FIG. 1, the half-loop shaped radiating electrode 30 of the loop antenna section 3 is vertically erected on the non-ground region 101. Thus, as indicated by a two-dot chain line, a mirror image 30' of the real radiating electrode 30 is formed on the ground region 102 side. As a result, as illustrated in FIG. 7, a one wave length loop antenna is formed by the real radiating electrode 30 and the mirror image 30' in the ground region 102.

Consequently, in a state where the signal S2 at 5 GHz is resonant, resonance occurs in such a way that the current at the distal end 32 and the proximal end 31 is at a maximum Imax, and the current in a middle, or center 33 is substantially zero. As a result, a vertically polarized wave V that becomes gradually stronger from the proximal end 31 and the distal end 32 toward the middle 33 is radiated from the radiating electrode 30.

Therefore, as illustrated in FIG. 8, a radio wave S2' includes a strong vertically polarized wave V perpendicular to a surface 100*a* of the board 100 and a horizontally polarized wave H parallel to the surface 100*a*, and this radio wave S2' is radiated from the radiating electrode 30.

In contrast, the radiating electrode 20 of the monopole antenna section 2 is formed as a pattern in the surface 100*a*, and thus has no height from the surface 100*a*. Consequently, only a horizontally polarized wave is radiated from the radiating electrode 20.

Incidentally, in an antenna section having a radiating electrode that is erected perpendicularly to the board surface, even when the height of this radiating electrode (the radiating electrode 30 in the embodiment) is the same, when the structural design of the radiating electrode differs, so does the strength of the radiated vertically polarized wave V. The inventors assumed that a radiating electrode with a loop antenna design whose electrical length is one-half of the wave length radiates the strongest vertically polarized wave V.

To verity this, the inventors conducted the following simulation.

Figure 9:
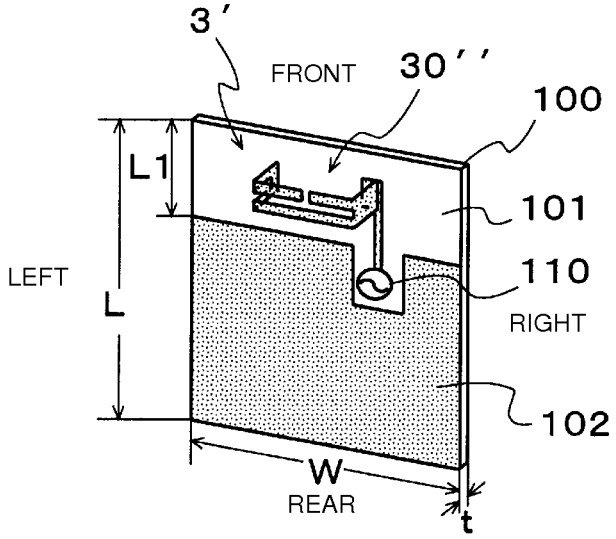
FIG. 9 is a perspective view of a board on which an antenna section having a radiating electrode with a monopole loop antenna design is mounted.
Figure 10:
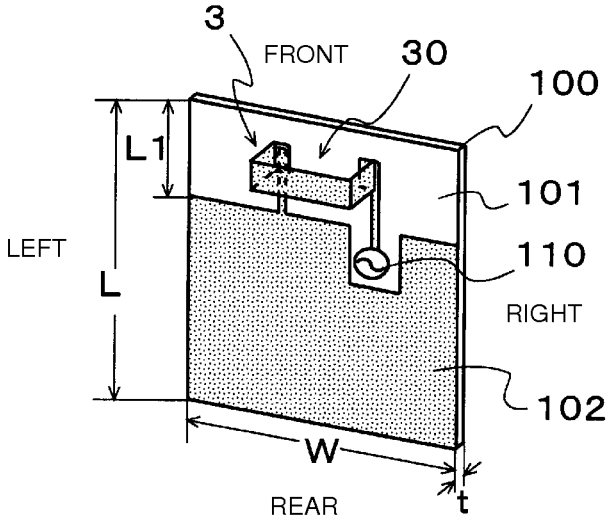
FIG. 10 is a perspective view of a board on which an antenna section having a radiating electrode with a loop antenna design is mounted.

FIG. 9 is a perspective view of a board on which an antenna section having a radiating electrode with a monopole loop antenna design is mounted. FIG. 10 is a perspective view of a board on which an antenna section having a radiating electrode with a loop antenna design is mounted.

This simulation used the board 100 whose width W, length L, and thickness t are 40 mm, 45 mm, and 1.5 mm, respectively, and whose non-ground region 101 has a width W and a length L1 of 40 mm and 10 mm, respectively.

An antenna section 3' illustrated in FIG. 9 has a radiating electrode 30" with a monopole antenna design whose electrical length is three-quarters of the wave length corresponding to a frequency of 5.2 GHz.

First, the inventors fed a signal at 5.2 GHz to the radiating electrode 30" of the antenna section 3' from the feed section 110, and measured the directivity of the vertically polarized wave V radiated from the radiating electrode 30.

Figure 11:
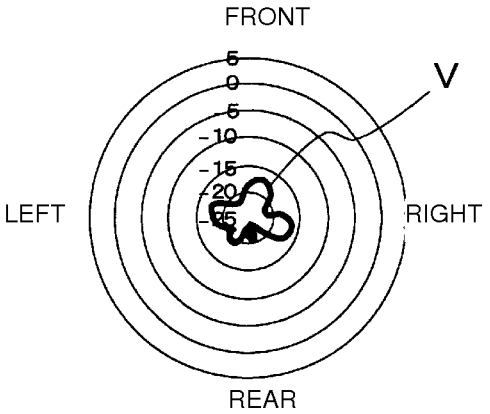
FIG. 11 is a diagram illustrating the directivity of a vertically polarized wave V radiated from the radiating electrode with a monopole antenna design.

FIG. 11 is a diagram illustrating the directivity of the vertically polarized wave V radiated from the radiating electrode 30" with a monopole antenna design.

As is apparent from FIG. 11, in the case of the radiating electrode 30" with a monopole antenna design whose electrical length is three-quarters of the wave length corresponding to a frequency of 5.2 GHz, the directivity is not greater than −15 dBi with respect to all directions, front, rear, right, and left, of the board 100, and the strength of the vertically polarized wave V is small. That is, it is understood that the radiating electrode 30" with a monopole antenna design is unable to provide a strong directivity.

Next, as illustrated in FIG. 10, the same simulation was conducted for the radiating electrode 30 of the loop antenna section 3 according to the present embodiment.

That is, the height of the radiating electrode 30 was set to the same height as that of the radiating electrode 30" of the antenna section 3' mentioned above, the electrical length of the radiating electrode 30 was set to one-half of the wave length corresponding to a frequency of 5.2 GHz, and the radiating electrode 30 was designed as a loop antenna.

Then, a signal at 5.2 GHz was fed to the radiating electrode 30 of the loop antenna section 3 from the feed section 110, and the directivity of the vertically polarized wave V radiated from the radiating electrode 30 was measured.

Figure 12:
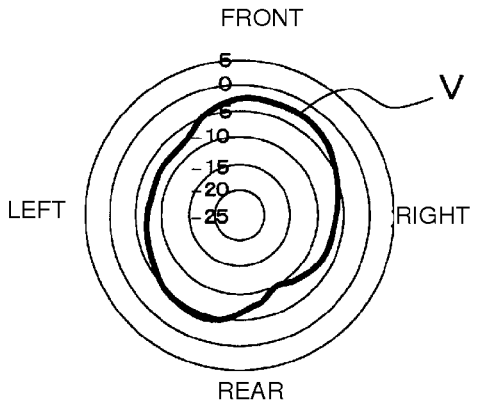
FIG. 12 is a diagram illustrating the directivity of a vertically polarized wave V radiated from the radiating electrode with a loop antenna design.

FIG. 12 is a diagram illustrating the directivity of the vertically polarized wave V radiated from the radiating electrode 30 with a loop antenna design.

As is apparent from FIG. 12, it is understood that when the radiating electrode 30 with a loop antenna design whose electrical length is one-half of the wave length corresponding to a frequency of 5.2 GHz is used, the vertically polarized wave V in the directions of the front and rear of the board 100 is very strong. In particular, a very strong vertically polarized wave V close to 0 dBi is radiated in the front direction.

As described above, the antenna unit 1 according to the present embodiment makes it possible to almost completely prevent interference between the monopole antenna section 2 and the loop antenna section 3. Therefore, the monopole antenna section 2 and the loop antenna section 3 can be designed independently. As a result, the antenna unit 1 can be easily designed.

Further, since the radiating electrode 30 of the loop antenna section 3 is erected perpendicularly to the surface 100*a* of the board 100, a strong vertically polarized wave V can be obtained. Moreover, as compared with a case where the radiating electrode 30 is mounted so as to lie sideways on the non-ground region 101, the mounting area can be made small, and the antenna unit 1 can be miniaturized accordingly.

Next, a second exemplary embodiment will be described.

Figure 13:
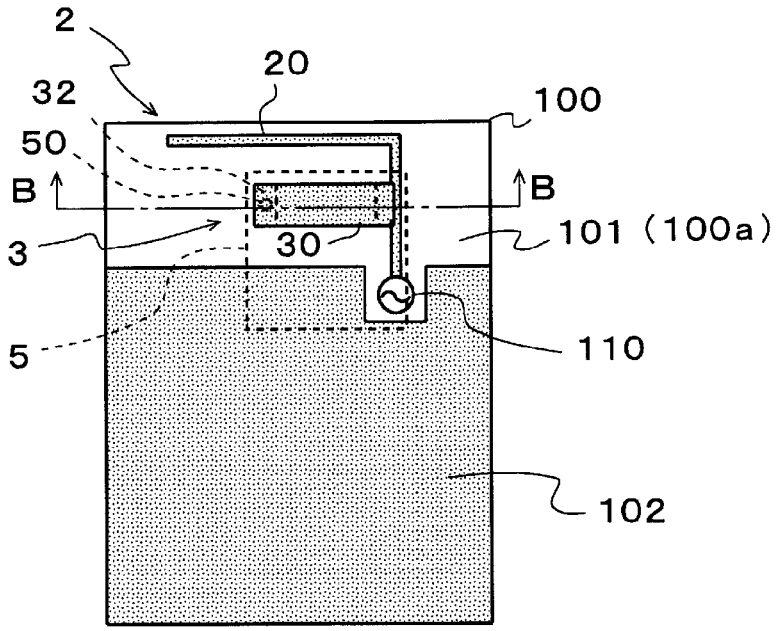
FIG. 13 is a plan view of an antenna unit according to a second exemplary embodiment.
Figure 14:
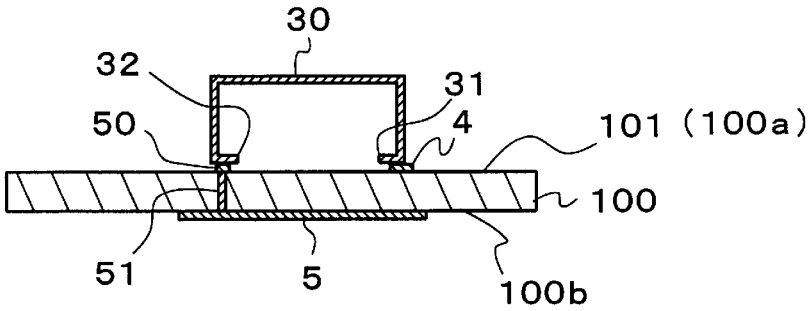
FIG. 14 is a cross-sectional view in the direction of arrow B-B in FIG. 13.

FIG. 13 is a plan view of an antenna unit according to the second embodiment of the present disclosure. FIG. 14 is a cross-sectional view in the direction of arrow B-B in FIG. 13.

As illustrated in FIG. 13 and FIG. 14, the antenna unit according to the present embodiment differs from that of the first embodiment mentioned above in that a ground layer 5 is provided directly at the back of the radiating electrode 30 of the loop antenna section 3.

Specifically, the ground layer 5 having a square shape is formed in a location on a backside 100*b* of the board 100 opposite to the radiating electrode 30. Then, the distal end 32 of the radiating electrode 30 is placed on a land 50 on top of the non-ground region 101, and the land 50 and the ground layer 5 are connected by a through-hole 51.

In the first exemplary embodiment mentioned above, the distal end 32 of the radiating electrode 30 is connected to the ground region 102 formed in the surface 100*a* of the board 100. Thus, the distance between the radiating electrode 30 and the ground region 102 is somewhat large. Consequently, from the radiating electrode 30, not only a vertically polarized wave V but also a somewhat strong horizontally polarized wave H is generated parallel to the surface 100*a* of the board 100. As a result, noise radiated from a radio frequency (RF) circuit or base band (BB) circuit (not illustrated) mounted on the surface 100*a* of the board 100 is superimposed on the horizontally polarized wave H generated from the ground current of the board 100, which may case degradation of radio waves radiated from the radiating electrode 30.

In contrast, as illustrated in FIG. 14, in this embodiment, the ground layer 5 on the backside 100*b* of the board 100 is located opposite the radiating electrode 30, and thus the radiating electrode 30 and the ground layer 5 are in very close distance to each other. Consequently, the proportion of vertically polarized wave V generated from the radiating electrode 30 becomes very large, and the horizontally polarized wave H is suppressed. As a result, noise radiated from the RF circuit or BB circuit is not superimposed on the horizontally polarized wave H, and degradation of radio waves due to such noise is avoided.

Moreover, because a capacitance between the radiating electrode 30 and the ground layer 5 becomes larger than a capacitance between the radiating electrode 30 and the board 100, the Q factor of the loop antenna section 3 can be enhanced.

Since the configuration, operation, and effect of the second embodiment are otherwise the same as those of the first embodiment mentioned above, a description thereof is not provided.

Next, a third exemplary embodiment will be described.

Figure 15:
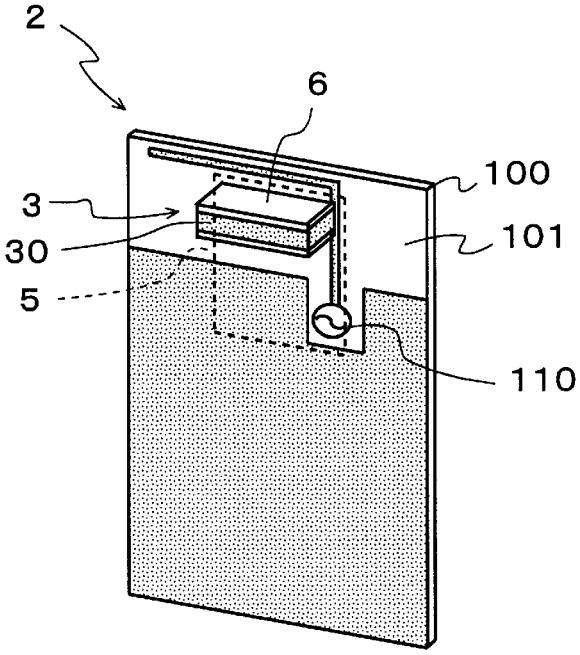
FIG. 15 is a perspective view of an antenna unit according to a third exemplary embodiment.
Figure 16:
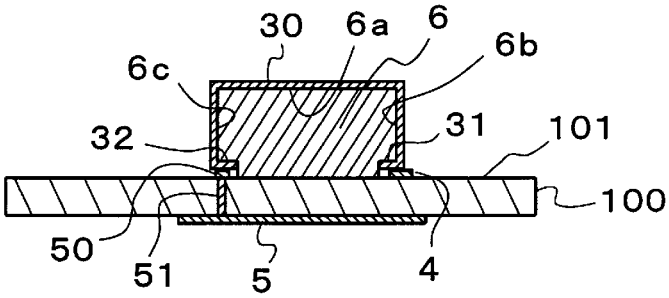
FIG. 16 is a cross-sectional view of the main portion of the antenna unit.

FIG. 15 is a perspective view of an antenna unit according to the third embodiment of the present disclosure. FIG. 16 is a cross-sectional view of the main portion of the antenna unit.

As illustrated in FIG. 15, the antenna unit according to this embodiment differs from those of the first and second exemplary embodiments mentioned above in that the radiating electrode 30 of the loop antenna section 3 is formed on a dielectric base 6.

That is, the dielectric base 6 having a rectangular parallelepiped shape is attached onto the non-ground region 101 of the board 100, and the radiating electrode 30 is formed on the surface of the dielectric base 6. Specifically, as illustrated in FIG. 16, the proximal end 31 of the radiating electrode 30 is connected to the feed line 4, the radiating electrode 30 is formed over a right side face 6*b*, an upper face 6*a*, and a left side face 6*c* of the dielectric base 6, and the distal end 32 of the radiating electrode 30 is connected to the land 50.

According to this configuration, by means of the dielectric base 6, the actual physical length of the radiating electrode 30 of the loop antenna section 3 can be shortened while keeping the electrical length of the radiating electrode 30 at one-half of the wave length. Therefore, further miniaturization of the loop antenna section 3 can be achieved.

Moreover, the electric field of the vertically polarized wave V generated in the loop antenna section 3 can be further strengthened by means of the dielectric base 6. Therefore, further strengthening of the vertically polarized wave V can be achieved.

Since the configuration, operation, and effect of the third embodiment are otherwise the same as those of the first and second embodiments mentioned above, a description thereof is not provided.

Next, a fourth exemplary embodiment will be described.

Figure 17:
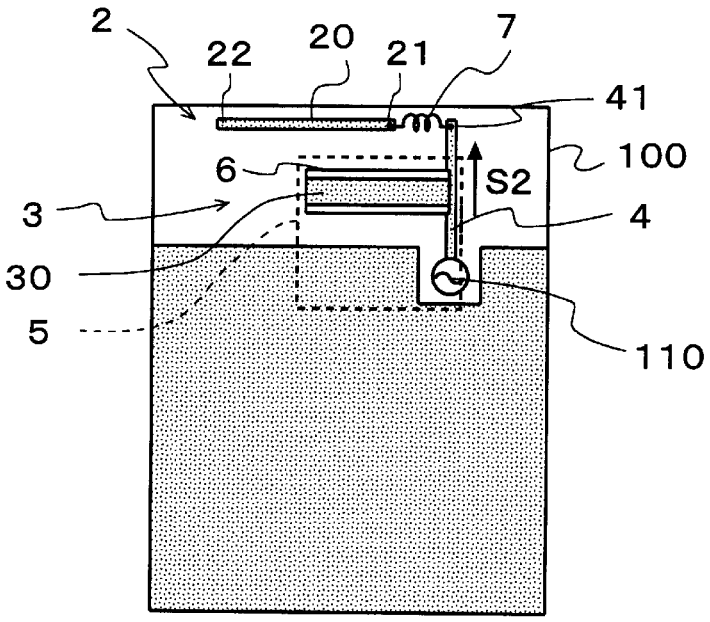
FIG. 17 is a plan view of an antenna unit according to a fourth exemplary embodiment.

FIG. 17 is a plan view of an antenna unit according to the fourth embodiment of the present disclosure.

As illustrated in FIG. 17, this embodiment differs from the first to third exemplary embodiments mentioned above in that a choke coil 7 is interposed between the radiating electrode 20 of the monopole antenna section 2 and the feed line 4.

That is, the choke coil 7 has an inductance value that can block the signal S2 at 5 GHz that is the operating frequency of the loop antenna section 3. The depicted right end of the choke coil 7 is connected to the distal end portion 41 of the feed line 4, and the left end is connected to the proximal end 21 of the radiating electrode 20.

According to this configuration, when the signal S2 at 5 GHz reaches the distal end portion 41 from the feed section 110 through the feed line 4, the signal S2 is blocked by the choke coil 7, thereby blocking entry of the signal S2 into the radiating electrode 20. As a result, the non-interference interference performance of the monopole antenna section 2 with respect to the signal S2 at 5 GHz improves.

Moreover, owing to the inductance value of the choke coil 7, the actual physical length of the radiating electrode 20 of the monopole antenna section 2 can be shortened while keeping its electrical length at one-quarter of the wave length. Therefore, the monopole antenna section 2 can be miniaturized.

Since the configuration, operation, and effect of the fourth embodiment are otherwise the same as those of the first to third exemplary embodiments mentioned above, a description thereof is not provided.

Embodiments consistent with the present disclosure are not limited to the above-mentioned embodiments but various modifications and changes are possible.

For example, while 2.4 GHz is used as the first frequency and 5 GHz is used as the second frequency in the above-mentioned embodiments, the first and second frequencies are not limited to 2.4 GHz and 5 GHz, respectively. It suffices that the second frequency of the loop antenna section 3 be substantially twice the first frequency of the monopole antenna section 2.

In embodiments consistent with the present disclosure, the radiating electrode of the monopole antenna section resonates at the first frequency, thereby enabling transmission and reception at this frequency. Moreover, the radiating electrode of the loop antenna section resonates at the second frequency, thereby enabling transmission and reception at this frequency.

At this time, the electrical length of the radiating electrode of the monopole antenna section is set to one-quarter of the wave length corresponding to the first frequency, and the electrical length of the radiating electrode of the loop antenna section is set to one-half of the wave length corresponding to the second frequency that is approximately twice the first frequency. Consequently, the proximal end portion of the radiating electrode of the monopole antenna section becomes high impedance with respect to a signal at the second frequency fed from the feed section, and the proximal end portion of the radiating electrode of the loop antenna section becomes high impedance with respect to a signal at the first frequency fed from the feed section. As a result, interference between the loop antenna section and the monopole antenna section is suppressed.

Moreover, the half-loop shaped radiating electrode of the loop antenna section is vertically erected on the non-ground region. Therefore, the electric field in the vertical direction generated in the radiating electrode becomes strong, and a strong vertically polarized component is radiated from the loop antenna section. Further, as compared with a case where the half-loop shaped radiating electrode is mounted on the non-ground region in a laid down fashion, the mounting area for the radiating electrode can be made small.

As has been described above in detail, the antenna unit according to the present disclosure has the advantageous effect of being able to prevent interference between the loop antenna section and the monopole antenna section. Moreover, owing to this effect, the loop antenna section and the monopole antenna section can be designed independently, thereby enabling easy antenna design.

Further, the half-loop shaped radiating electrode of the loop antenna section is vertically erected on the non-ground region. Therefore, not only a strong vertically polarized component can be radiated from this radiating electrode, but also the mounting area for the radiating electrode can be made small, and the antenna unit can be miniaturized accordingly.

Additionally, in an embodiment including a ground layer provided in a location on a backside of the board opposite to the radiating electrode of the loop antenna section, and the distal end of the radiating electrode of the loop antenna section is connected to the ground layer, the vertically polarized component generated in the radiating electrode of the loop antenna section can be further strengthened. As a result, it is possible to avoid the influence of noise generated in the board.

According to this configuration, where the vertically polarized component generated in the radiating electrode of the loop antenna section becomes further strong, by adjusting the size of the ground layer, it is possible to make almost only the vertically polarized wave be radiated from the radiating electrode. As a result, the proportion of radiation from the antenna itself increases, and the proportion of radiation from the ground of the entire board decreases. Consequently, the influence of noise generated from components mounted on the ground is lessened, thereby enabling favorable transmission and reception with no noise for the signal at the second frequency.

In an embodiment in which the radiating electrode of the loop antenna section is formed on a surface of a dielectric base attached onto the non-ground region, the loop antenna section can be further miniaturized, and also further strengthening of the vertically polarized component can be achieved.

According to this configuration, owing to the dielectric base, the physical length of the radiating electrode of the loop antenna section can be shortened while keeping its electrical length at a desired value. Consequently, further miniaturization of the loop antenna section becomes possible.

Moreover, the electric field in the vertical direction generated in the loop antenna section can be further strengthened by means of the dielectric base, thereby further strengthening the vertically polarized component.

In embodiments including a choke coil for blocking a signal at the second frequency interposed between the proximal end of the radiating electrode of the monopole antenna section and the distal end portion of the feed line, non-interference performance between the monopole antenna section and the loop antenna section can be enhanced, and also miniaturization of the monopole antenna section can be achieved.

According to this configuration, before the signal at the second frequency enters the radiating electrode of the monopole antenna section, this signal is blocked by the choke coil. Therefore, the non-interference performance of the monopole antenna section with respect to the signal at the second frequency improves.

Moreover, owing to the inductance value of the choke coil, the physical length of the radiating electrode of the monopole antenna section can be shortened while keeping its electrical length at a desired value. Consequently, further miniaturization of the monopole antenna section can be achieved.

Also, a radio communication device including an antenna unit consistent with the present disclosure, it is advantageously possible to provide a radio communication device having superior non-interference performance and also having a small size.

That which is claimed is:

1. An antenna unit comprising:

a single feed line extending from a feed section onto a non-ground region of a surface of a board;

a monopole antenna section including a radiating electrode having a linear shape, the radiating electrode being provided on the non-ground region and including a proximal end and distal end, the proximal end of the radiating electrode being connected to a distal end portion of the feed line and the distal end of the radiating electrode being open; and a loop antenna section including a radiating electrode having a half-loop shape and being vertically erected on the non-ground region, the radiating electrode of the loop antenna section including a proximal end and a distal end, the proximal end of the loop antenna radiation electrode being connected to an intermediate portion of the feed line and the distal end of the loop antenna radiation electrode being grounded, wherein an electrical length of the radiating electrode in the monopole antenna section is set to one-quarter of a wave length corresponding to a first frequency, and an electrical length of the radiating electrode in the loop antenna section is set to one-half of a wave length corresponding to a second frequency that is approximately twice the first frequency.

2. The antenna unit according to claim 1, further comprising:

a ground layer on a backside of the board opposite to the radiating electrode of the loop antenna section, wherein the distal end of the radiating electrode of the loop antenna section is connected to the ground layer.

3. The antenna unit according to claim 2, wherein the radiating electrode of the loop antenna section is on a surface of a dielectric base attached onto the non-ground region.

4. The antenna unit according to claim 3, wherein a choke coil for blocking a signal at the second frequency is interposed between the proximal end of the radiating electrode of the monopole antenna section and the distal end portion of the feed line.

5. The antenna unit according to claim 3, wherein:

the first frequency is 2.4 GHz; and the second frequency is 5 GHz.

6. A radio communication device comprising the antenna unit according to claim 3.

7. The antenna unit according to claim 2, wherein a choke coil for blocking a signal at the second frequency is interposed between the proximal end of the radiating electrode of the monopole antenna section and the distal end portion of the feed line.

8. The antenna unit according to claim 2, wherein:

the first frequency is 2.4 GHz; and the second frequency is 5 GHz.

9. A radio communication device comprising the antenna unit according to claim 2.

10. The antenna unit according to claim 1, wherein the radiating electrode of the loop antenna section is on a surface of a dielectric base attached onto the non-ground region.

11. The antenna unit according to claim 10, wherein a choke coil for blocking a signal at the second frequency is interposed between the proximal end of the radiating electrode of the monopole antenna section and the distal end portion of the feed line.

12. The antenna unit according to claim 10, wherein:

the first frequency is 2.4 GHz; and the second frequency is 5 GHz.

13. A radio communication device comprising the antenna unit according to claim 10.

14. The antenna unit according to claim 1, wherein a choke coil for blocking a signal at the second frequency is interposed between the proximal end of the radiating electrode of the monopole antenna section and the distal end portion of the feed line.

15. The antenna unit according to claim 14, wherein:

the first frequency is 2.4 GHz; and the second frequency is 5 GHz.

16. A radio communication device comprising the antenna unit according to claim 14.

17. The antenna unit according to claim 1, wherein:

the first frequency is 2.4 GHz; and the second frequency is 5 GHz.

18. A radio communication device comprising the antenna unit according to claim 17.

19. A radio communication device comprising the antenna unit according to claim 1.

* * * * *